US005333875A

United States Patent [19]

Wilson

[11] Patent Number: 5,333,875

[45] Date of Patent: Aug. 2, 1994

[54] ALIGNMENT SYSTEM FOR GOLF BALL DRIVING AND HITTING MAT

[75] Inventor: Donald A. Wilson, Salt Lake City, Utah

[73] Assignee: Optronics, Ltd., Salt Lake City, Utah

[21] Appl. No.: 987,453

[22] Filed: Dec. 7, 1992

[51] Int. Cl.[5] ..... A63B 69/36

[52] U.S. Cl. ..... 273/187.1

[58] Field of Search ..... 273/186.1, 187.1, 187 A, 273/195 A, 195 R; 434/252

[56] References Cited

U.S. PATENT DOCUMENTS

| | | | |
|---|---|---|---|
| 2,707,638 | 5/1955 | Manley | 273/187 A |
| 2,866,645 | 12/1958 | Cayot | 273/187.1 |
| 3,311,377 | 3/1967 | Holbus | 273/186.1 |
| 3,414,266 | 12/1968 | Mitchell | 273/195 A X |
| 3,586,335 | 6/1971 | Antonio | 273/187.1 |
| 3,649,029 | 3/1972 | Worrell | 273/187.1 X |
| 3,934,882 | 1/1976 | Whittaker | 273/187.1 |
| 4,000,905 | 1/1977 | Shirhall | 273/187 A |
| 4,545,581 | 10/1985 | Williamson | 273/187 A |
| 4,826,174 | 5/1989 | Hoyt | 273/186.1 |
| 5,028,052 | 7/1991 | Miller | 273/195 A X |
| 5,071,130 | 12/1991 | Shofner | 273/195 A X |

*Primary Examiner*—George J. Marlo
*Attorney, Agent, or Firm*—Thorpe North & Western

[57] ABSTRACT

An alignment system for aiding in the alignment of a golf club with a golf ball prior to hitting the golf ball includes a pad of material having a bottom surface for placement on a support surface, and a resilient top surface on which the golf ball is to be placed for hitting. Also included are first and second stripes defined in the top surface of the pad in a side-by-side, generally parallel relationship at or near the location at which the golf ball is to be placed, for enabling the visual alignment of the golf club head relative to the stripes and the golf ball.

6 Claims, 1 Drawing Sheet

ALIGNMENT SYSTEM FOR GOLF BALL DRIVING AND HITTING MAT

BACKGROUND OF THE INVENTION

The invention relates to a golf ball driving and hitting mat having an alignment system which allows for aligning or squaring-off of a golf club with a golf ball placed on the mat.

Golf hitting and driving ranges, both indoor and outdoor, typically use a mat or pad from which the golf balls are hit. Such mats are typically made to provide, to the extent possible and practical, the look and feel of grass, and to accommodate and hold upright a golf tee on which a golf ball may be placed or alternatively to accommodate placing a golf ball directly on the upper surface of the mat. Such upper surface is defined by a plethora of individual fibers or strands closely packed together to provide a brush-like appearance. Such fibers or strands may be made of a variety of synthetic materials including polypropylene and polyethylene, the bottom ends of which are anchored in a holding or support pad.

Of course, the reason for providing such golf hitting and driving ranges is to allow players to practice and improve their driving and hitting skills. For example, it is the goal of most players to acquire the skill of hitting a golf ball as straight as possible and to eliminate generally undesirable slices (golf ball curves to the right, looking in the direction in which the golf ball is hit) and hooks (golf ball curves to the left after hitting). A number of factors affect whether a player slices, hooks or drives a golf ball generally straight including the mechanics of the player's swing, and the position of the golf club head, relative to the ball, upon impact of the golf club head with the ball. Thus, if a player can improve the mechanics of the swing and/or the alignment of the golf club head with the golf ball upon impact, then the player can generally improve his or her driving and hitting skill and accuracy.

SUMMARY OF THE INVENTION

It is an object of the invention to provide a golf ball hitting and driving mat which includes a mechanism for allowing the player to better align the golf club head with the golf ball being hit.

It is another object of the invention to provide such a mat which is simple and inexpensive to construct.

It is a further object of the invention to provide such a mat and system which in no way interferes or impedes the player's swing and striking of the golf ball.

The above and other objects of the invention are realized in a specific illustrative embodiment of a golf ball driving and hitting mat comprising a pad of material having a bottom side for placement on a support surface and a top side. The pad includes a plurality of fibers closely spaced and upstanding from the top side of the pad to define an upper surface for supporting a golf ball to be driven or hit from the pad. The pad also includes a pair of stripes defined in the upper surface and spaced apart in a generally parallel relationship, extending side-by-side, in a direction in which the golf ball is to be hit or driven.

Advantageously, and in accordance with one aspect of the invention, the spacing between the stripes is less than the diameter of the golf ball so that in use, the golf ball may be placed onto the pad at a location between the stripes. Then, when aligning the golf club head in preparation for striking the golf ball, a visual examination of the angles of the face of the golf club head with the two stripes will readily reveal whether the golf club head is properly aligned with the ball, i.e., whether the striking of the ball will result in the ball moving off in the desired direction.

BRIEF DESCRIPTION OF THE DRAWINGS

The above and other objects and advantages of the invention will become apparent from a consideration of the following detailed description presented in connection with the accompanying drawings in which.

DETAILED DESCRIPTION

Figure 1:
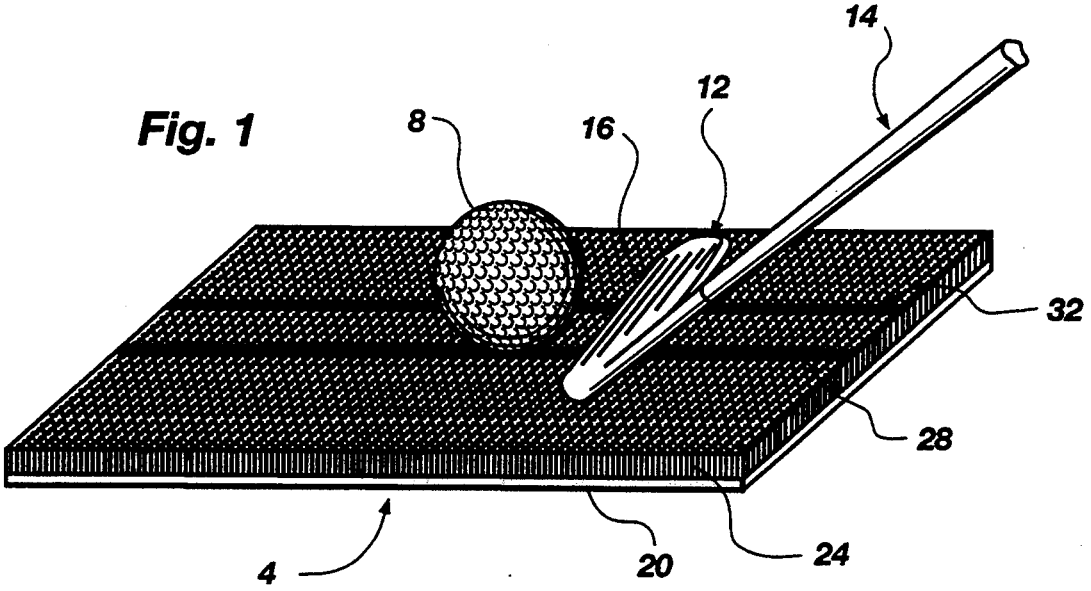
FIG. 1 is a perspective view of a golf ball driving and hitting mat with alignment system, made in accordance with the principles of the present invention.

Referring to the drawings, there is shown one embodiment of the present invention to include a mat 4 on which is placed a golf ball 8 to be struck by the head 12 of a golf club 14 (shown in fragmented form). The mat 4 is constructed, in a conventional fashion, of a base pad or support 20 (FIG. 1) made, for example, of webbing or a lattice of material into which may be secured the lower end of a plurality of fibers 24. The fibers may be grouped together in a bundle of four or five in number to extend from a plug upwardly and outwardly, and the plug then inserted into the base pad 20, again in a conventional fashion. When numerous such fiber plugs are anchored in the pad 20, the fibers define or present an resilient upper surface which is generally flat (but of course could be contoured), and returns to its original form following each stroke of a golf club. Such construction of golf ball driving and hitting mats is well-known in the art and is available in commercial form from Fiberbuilt Company in Alberta, Canada.

Figure 2:
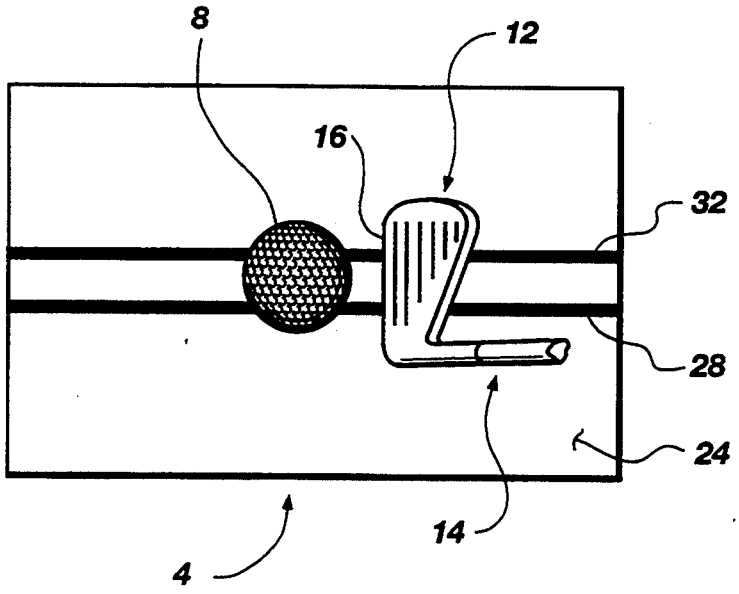
FIG. 2 is a top, plan view of the mat of FIG. 1.

The improvement which is the subject of the present application comprises provision of two, generally parallel stripes or lines 28 and 32 on the upper surface of the mat 4. The stripes 28 and 32 might be provided simply by coloring the upper ends of fibers 24 along two linear loci as shown in FIGS. 1 and 2. Alternatively, the stripes 28 and 32 might be formed by using fibers of one color plugged into the pad 20 along two linear loci coinciding with the location of stripes 28 and 32, and using a different color for all of the other fibers 24.

Advantageously, the stripes 28 and 32 are positioned to extend the full length of the mat 4 (although less than full length would also suffice), and are spaced apart a distance less than the diameter of a golf ball (such as golf ball 8), as shown. Although the pad is shown as being rectangular, other shapes could also be provided. However, providing a rectangular pad, and then aligning the stripes 28 and 32 parallel with the long sides of the mat, enables a player to more easily align the golf club head 12 with the ball 8 in preparation for striking the ball.

The use of two parallel stripes 28 and 32 allows a player to align the golf club head 12, and in particular the front edge 16 of the golf club head, in a position to be generally perpendicular to an imaginary radial line extending from the center of the golf ball 8 rearwardly towards the golf club head 12. With the stripes 28 and 32 in place, this can be done more easily by simply viewing the front edge 16 of the golf club head 12 with respect to the stripes and moving the golf club head until the front edge 16 forms a right angle with both stripes 28 and 32. If just one stripe were used, it would be more difficult to detect or visually note a slight rotation of the golf club head 12 away from a right angle; but, with two stripes, the two stripes form one side of the square with the front edge 16, and any slight rotation in the golf club head is readily noted visually by the player. The player can then readjust the positioning of the golf club head 12, for example, by changing his/her grip or other adjustments preparatory to hitting the ball. Of course, the better the alignment of the golf club head 12 with the ball 8, the more sure and straight will be the direction in which the ball is hit.

An ancillary utility of the alignment system of the present invention is that for a player using the same mat and system over a period of time, wear occurring more on the inner or outer stripe (relative to the player) will provide an indication that the player is swinging with the golf club head heel or toe respectively too low (thus causing the greater wear). This ancillary utility is possible if the stripes are spaced apart a distance about equal to or less than the length of the golf club face.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

I claim:

1. A golf ball driving and hitting system comprising a golf ball, and a mat consisting of a pad of resilient material having a periphery, a predetermined thickness, a bottom surface for placement on a support surface, a top surface on which the golf ball is to be placed for hitting, first and second stripes defined in the top surface on the pad in a side-by-side, generally parallel relationship at the location at which the golf ball is to be placed, for enabling the visual alignment of a golf club head relative to the stripes and the golf ball, the first and second stripes being spaced apart a distance of less than the diameter of the golf ball, and a third stripe positioned between the first and second stripes for spacing apart the first and second stripes, the third stripe being of a color different from that of the first and second stripes.

2. A golf ball driving and hitting mat as in claim 1 wherein the pad is generally rectangular in shape, and wherein the stripes extend lengthwise of the pad substantially the full length thereof.

3. An alignment system as in claim 1 wherein said stripes are spaced apart a distance which is about equal to or less than the length of a golf club face.

4. The system of claim 5 wherein said pad comprises a plurality of fibers closely spaced and upstanding from the top side of the pad to define an upper surface for supporting the golf ball to be driven or hit from the pad, the upper surface being of a generally homogeneous color.

5. A golf ball driving and hitting mat as in claim 4 wherein the stripes are formed by locating fibers of a one color at the loci of the stripes, and fibers of a different color elsewhere on the pad.

6. A golf ball driving and hitting mat as in claim 4 wherein the pair of stripes are formed by coloring the top ends of the fibers at the loci of said stripes, the coloring being removable such that repeated striking of the fibers will produce a distinct wear pattern.

* * * * *